US005667367A

United States Patent [19]

Kubo et al.

[11] Patent Number: 5,667,367

[45] Date of Patent: Sep. 16, 1997

[54] AIR COMPRESSOR

[75] Inventors: Kazuo Kubo; Koji Akashi, both of Hyogo, Japan

[73] Assignee: Kabushiki Kaisha Kobe Seiko Sho, Kobe, Japan

[21] Appl. No.: 416,990

[22] Filed: Apr. 5, 1995

[30] Foreign Application Priority Data

Apr. 8, 1994 [JP] Japan ..... 6-070529
Apr. 8, 1994 [JP] Japan ..... 6-070532

[51] Int. Cl.[6] ..... F04B 49/02; F04B 39/02; F04B 53/20

[52] U.S. Cl. ..... 417/313; 417/312; 181/249; 418/DIG. 1; 418/100

[58] Field of Search ..... 417/313, 295, 417/312; 418/100, 201.2, DIG. 1; 181/247, 248, 249, 255

[56] References Cited

U.S. PATENT DOCUMENTS

| | | | |
|---|---|---|---|
| 1,811,762 | 6/1931 | Schnell | 181/248 |
| 1,844,105 | 2/1932 | Scvhnell | 417/312 |
| 1,857,845 | 5/1932 | Hamilton | 181/256 |
| 3,168,236 | 2/1965 | Lamberton et al. | 417/295 |
| 3,260,444 | 7/1966 | Williams et al. | 417/228 |
| 3,448,916 | 6/1969 | Fraser | 417/228 |
| 3,482,768 | 12/1969 | Cirrincione et al. | 417/295 |
| 3,582,233 | 6/1971 | Bloom | 417/12 |
| 3,602,610 | 8/1971 | Bloom | 417/295 |
| 3,632,231 | 1/1972 | Bloom | 417/295 |
| 4,063,855 | 12/1977 | Paul | 418/100 |
| 4,089,623 | 5/1978 | Hofmann, Jr. | 417/295 |
| 4,371,053 | 2/1983 | Jones | 181/249 |
| 4,671,750 | 6/1987 | Miyoshi et al. | 418/150 |
| 4,695,233 | 9/1987 | Miyoshi et al. | 418/83 |
| 4,812,110 | 3/1989 | Kubo et al. | 418/1 |
| 4,834,214 | 5/1989 | Feuling | 181/255 |
| 5,033,944 | 7/1991 | Lassota | 418/1 |
| 5,134,856 | 8/1992 | Pillis et al. | 418/DIG. 1 |
| 5,171,130 | 12/1992 | Kume et al. | 417/228 |
| 5,176,505 | 1/1993 | Horii et al. | 417/295 |
| 5,199,858 | 4/1993 | Tsuboi et al. | 417/362 |
| 5,507,618 | 4/1996 | Kubo et al. | 415/182.1 |

*Primary Examiner*—Timothy Thorpe
*Assistant Examiner*—Peter G. Korytnyk
*Attorney, Agent, or Firm*—Oblon, Spivak, McClelland, Maier & Neustadt, P.C.

[57] ABSTRACT

An air compressor includes a compressor unit, an intake regulator valve connected to the compressor unit, and intake filter connected to the intake regulator valve, an oil separator connected to the compressor unit, an oil supply line connecting the lower part of the oil separator to various points inside the compressor unit, and an oil return line connecting the oil collector unit to the passage connecting the intake filter and the intake regulator valve. The passage connecting the intake filter to the intake regulator valve has a section of reduced cross-sectional area, including an inner tube having holes to connect to a surrounding hollow region. The oil return line opens into the passage at a point higher than the level of oil in the intake regulator valve.

2 Claims, 4 Drawing Sheets

AIR COMPRESSOR

FIELD OF THE INVENTION

The present invention relates to air compressors such as screw-type air compressors.

DESCRIPTION OF THE PRIOR ART

A typical prior art air compressor for example a screw-type air compressor is shown in FIG. 4. An intake line 12 and exit line 13 are respectively connected to the inlet and exit ports of a compressor unit 11, and an intake filter 14 and intake regulator valve 15 are installed in intake line 12. Air directed into the compressor unit via intake filter 14 and intake regulator valve 15 is compressed and then expelled into exit line 13.

There is the problem with the kind of prior art compressor described above that a lot of noise tends to leak from the inlet line 12 via the intake filter 14. Thus, as shown in FIG. 4 by the two-dot broken line, a noise dampening box 16 is fitted on the outside of intake filter 14. In this noise dampening box 16 are installed several noise dampening plates which block the direct flow of air.

However, the reduction in the amount of noise leakage achieved using the above kind of noise dampening box 16 is not deemed to be sufficient, and there is a demand for an improved method of noise reduction.

A prior art oil-cooled air compressor, as disclosed in Japanese Patent Publication Sho 63-156493 is shown in FIG. 5. This compressor comprises a compressor unit 21, an intake unit 22, an exit unit 23 and an oil supply line 24. The compressor unit 21 has provided therewith an oil collector unit 27 for collecting oil that leaks outside of the casing at the point where the drive shaft 26, used to drive the rotation of the rotors installed within the casing of the compressor unit, passes through the casing. For example, in the case of a screw type compressor, at least one of the ends of one of the pair of rotor shafts must be connected to the drive shaft of a motor 25 located outside the casing. Thus at least one hole is formed in the casing and one of the rotor shafts passes through this hole and is connected to the drive shaft of the motor. A shaft sleeve is fitted onto the rotor shaft at the point where it passes through the hole in order to block the small gap that exists between the surface of the rotor shaft and the wail of the hole formed in the casing. Lubricating oil is supplied to this shaft sleeve and other points such as the rotor housing where the compression of the air takes place, but despite this the formation of a small gap is inevitable due to the rotating nature of the rotor shaft. As a result, small amounts of oil leak from this area, and the oil collector unit is fitted to prevent this oil dripping onto surrounding components or onto the floor.

The intake unit is connected to the compressor unit 21 and comprises intake filter 28 and intake regulator valve 29. The exit unit is also connected to the compressor unit 21 and comprises oil separator 30. Oil supply line 24 extends from the lower part of the oil separator to a three way switch valve 32 where it breaks into two lines, one of which is connected to oil filter 34 via oil cooler 33, and the other is connected directly to oil filter 34. The oil supply line then extends from oil filter 34 to the bearings, shaft sleeve and rotor housing of the compressor unit 21.

In addition, an oil return line 35 connects the lower part of the oil collector unit 27 to the inlet side of the intake regulator valve. During operation of the compressor unit, the level of oil in the oil collector unit is higher than the level of oil in the intake regulator valve and this difference in height causes the oil collected in the oil collector unit 27 to flow to the inlet side of the intake regulator valve. This oil is sucked into the compressor unit 21 via intake regulator valve 29 together with air, and this air/oil mixture receives further injections of oil from oil supply line 24, is compressed and then expelled to oil separator 30. Separation of the oil from the air takes place inside this oil separator 30, and the compressed air separated from the oil then leaves the oil separator to an exit line connected to the upper part of the separator, while the oil thus separated is temporarily collected in an oil accumulation unit 31 located at the lower part of the oil separator 30. If the temperature of this oil exceeds a specific temperature, it is directed from three-way switch valve to oil intake filter 34 via oil cooler 33, if not it is directed from three-way switch valve directly to oil intake filter 34. From oil intake filter 34 the oil is directed to the bearings, shaft sleeve, and rotor housing of the compressor unit. In this way the lubricant oil is continually recirculated.

As described earlier, in this prior an air compressor, oil collected in oil collector unit 27 is returned to intake regulator valve 29, via oil return line 35 which connects the lower part of the oil collector unit 27 to the inlet side of the intake regulator valve and the flow of oil from the oil collector unit to the intake regulator valve is driven by the difference in heights of the level of oil in the collector unit 27 and intake regulator valve 29. However, when the operation of the compressor unit is stopped for some reason, oil flows from the compressor unit to the intake regulator valve 29, and consequently the level of oil in the intake regulator valve 29 increases. As a result, oil collected in intake regulator valve 29 tends to flow back via the oil return line to oil collector unit 27, and the oil collector unit 27 sometimes becomes full with oil. Then, if the compressor is then restarted whilst the oil collector unit 27 is full with oil, oil is sent flying by the rotation of the rotors, and the area surrounding the compressor unit 21 becomes covered with oil. In the case of belt-drive type compressors in which the drive of the motor is communicated to the rotor shaft via a pulley and belt, the belt is covered with oil, and there is the problem of loss of friction between the pulley and the belt causing slipping. Also, this wasteful discharge of oil increases the consumption of oil, and thus the frequency with which oil must be replenished is increased.

SUMMARY OF THE INVENTION

The present invention was made in the light of the problems existing in the prior art air compressors, and has as its objective the provision of an air compressor of simple construction in which the amount of noise leaking from the air filter is reduced, and an oil-cooled air compressor in which the wasteful discharge of oil from the oil collector unit is prevented.

The air compressor according to the present invention comprises a compressor unit, an intake regulator valve connected to the compressor unit, and an intake filter connected to the intake regulator valve, wherein the intake filter is connected to the intake regulator valve by a passage having a section of reduced cross-sectional area.

By reducing the cross-section of the passage connecting the intake regulator valve to the intake filter, the amount of noise leaking outside the compressor via this passage and the intake filter is reduced.

The present invention may be applied to an oil-cooled air compressor, comprising a compressor unit having a housing in which rotors are installed for rotation, and provided with an oil collector unit to collect oil leaking at the point where the shaft of one of the rotors passes through the housing to be connected to the drive shaft of a motor used to drive the rotation of the rotors; an intake regulator valve connected to said compressor unit; an intake filter connected to the intake regulator valve; an oil separator connected to said compressor unit; an oil supply line connecting the lower part of the oil separator to various points inside the compressor unit, to direct oil thereto; and an oil return line connecting the oil collector unit to the passage connecting the intake filter and the intake regulator valve. In this case, by reducing the cross-section of the passage connecting the intake filter and the intake regulator valve, a region of relatively low pressure is created downstream of the section of reduced cross-sectional area. This pressure difference can be used to effect the flow of oil collected in the oil collector unit through the oil return line back to the intake regulator valve, and thus the oil return line can be connected to the passage at a relatively high point i.e. higher than the maximum level of oil in the intake regulator valve. This construction ensures the flow of oil from the oil collector unit to the intake regulator valve and also ensures the prevention of oil flowing back from the intake regulator valve to the oil collector unit. Thus, problems such as oil discharge from the oil collector unit when restarting the compressor unit after a period of stoppage can be effectively prevented.

BRIEF DESCRIPTION OF THE DRAWINGS

These and other objects and features of the present invention will become clear from the following description taken in conjunction with the preferred embodiments thereof with reference to accompanying drawings, in which.

DETAILED DESCRIPTION OF THE INVENTION

Next, embodiments of the present invention shall be described with reference to the attached Figures.

Figure 1:
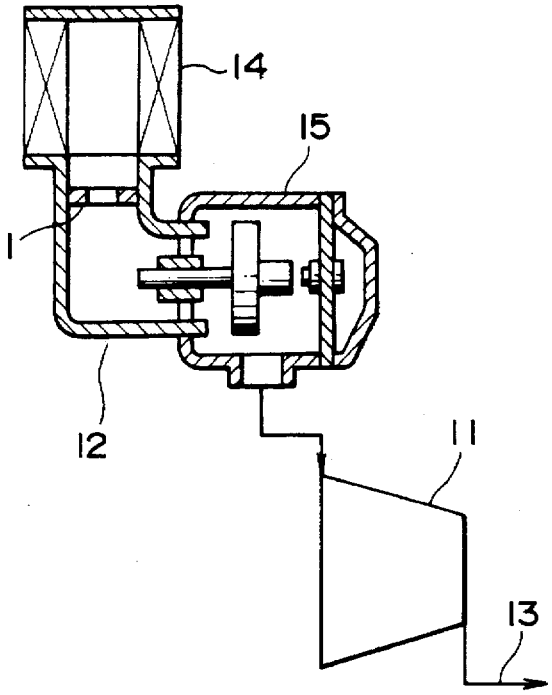
FIG. 1 shows a generalized plan of the air compressor according to a first embodiment of the present invention.
Figure 4:
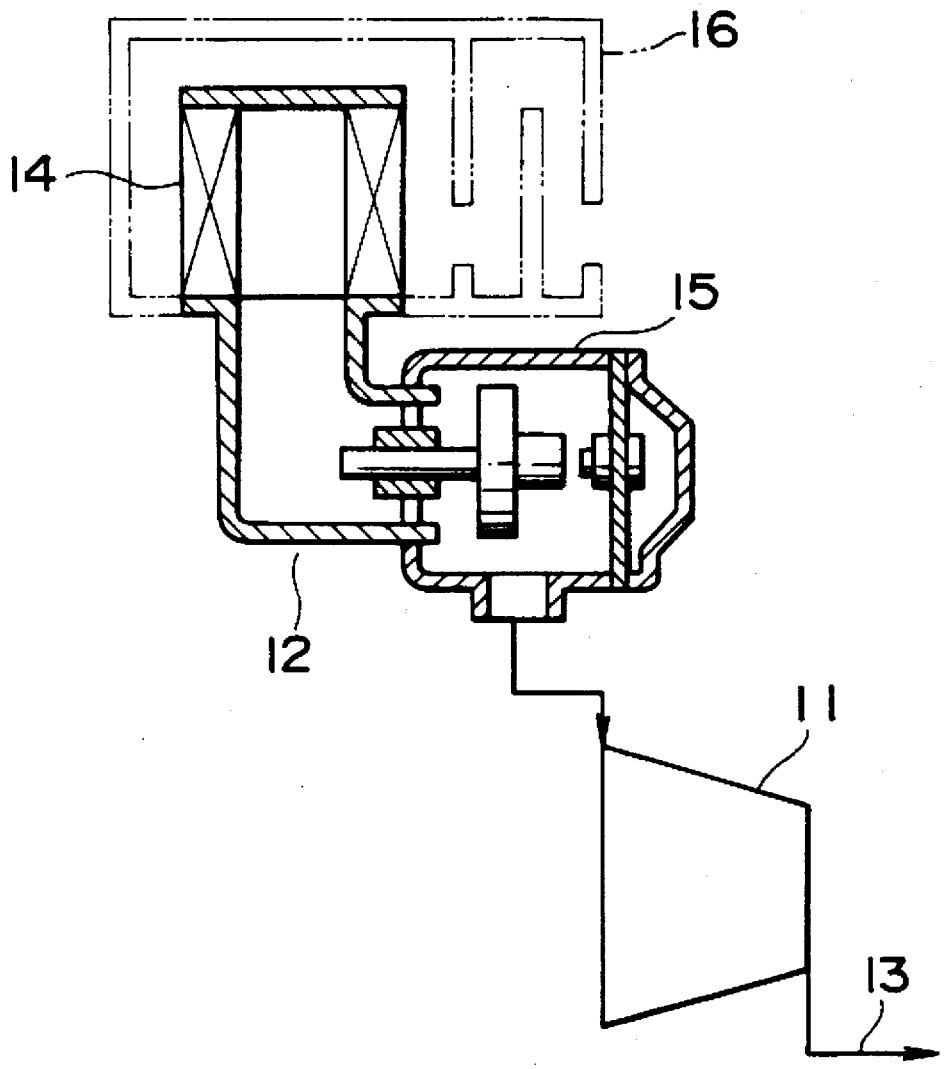
FIG. 4 PRIOR ART
FIG. 4 shows a generalized plan of a prior art air compressor.
Figure 5:
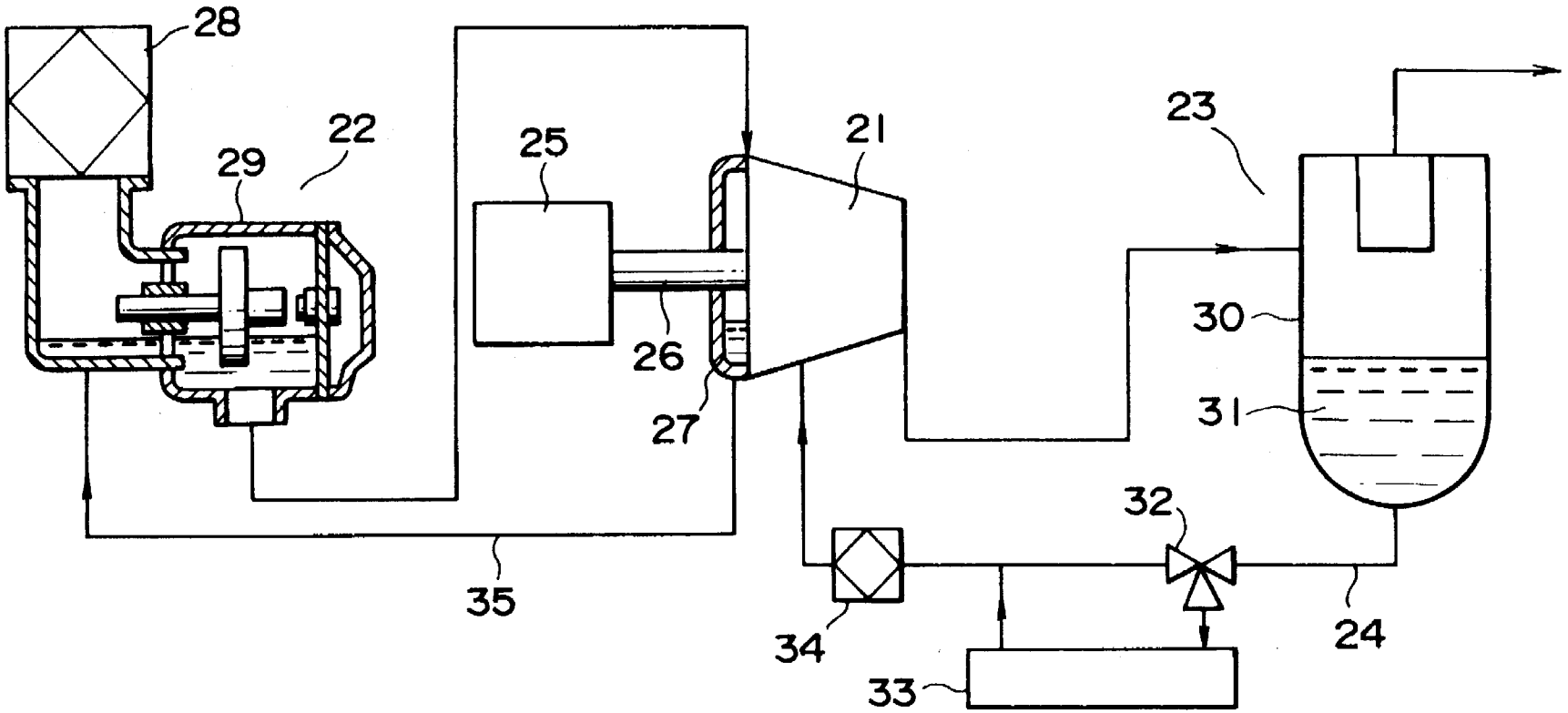
FIG. 5 PRIOR ART
FIG. 5 shows a generalized plan of a prior art air compressor.

FIG. 1 shows an air compressor, for example a screw-type compressor according to a first embodiment of the present invention. The construction is substantially similar to the prior art air compressor of FIG. 4 described earlier, except for the important feature of orifice 1, and thus the same reference numerals shall be used to designate common parts and a detailed explanation of those parts shall be omitted.

Inlet line 12 connecting oil filter 14 and intake regulator valve is designed such that air is forced to pass through a narrow orifice I. The small cross-sectional area of the orifice acts to impair the passage of noise from the intake regulator valve 15 to the intake filter 14. Accordingly, the amount of noise leaking to the outside of the compressor is reduced.

Figure 2:
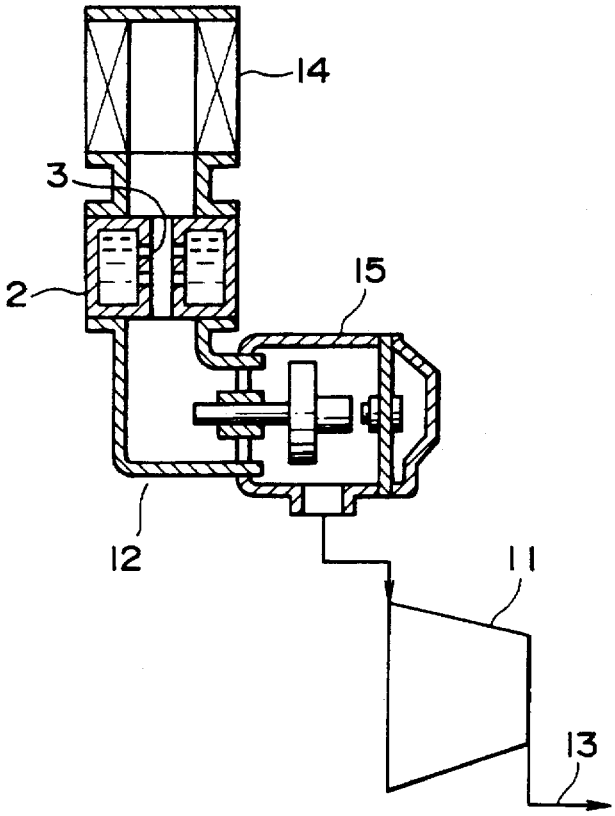
FIG. 2 shows a generalized plan of the air compressor according to a second embodiment of the present invention.

FIG. 2 shows an air compressor, for example a screw-type compressor according to a second embodiment of the present invention. The construction is substantially similar to the air compressor of FIG. 1, except for the feature that a hollow doughnut-shaped cylinder 2 having a center hole of a small cross-sectional area, replaces the orifice 1 of the fast embodiment, and thus the same reference numerals shall be used to designate common parts and a detailed explanation of those parts shall be omitted.

A hollow doughnut-shaped cylinder 2 is fitted in the inlet line 12 between the intake filter 14 and the intake regulator valve 15. Furthermore, the inner tube which forms the orifice, has small holes 3 formed therein in the radial direction. As in the fast embodiment, the cross-sectional area of the inlet line 12 is significantly narrowed, thereby impairing the passage of noise from the intake regulator valve 15 to the intake filter 14. In addition, noise passes through the small holes 3 into the hollow area and is reflected off the inner surface of the external cylinder forming the outer wall of the hollow cylindrical cylinder 2 and the noise reduction effect is thereby further enhanced.

Figure 3:
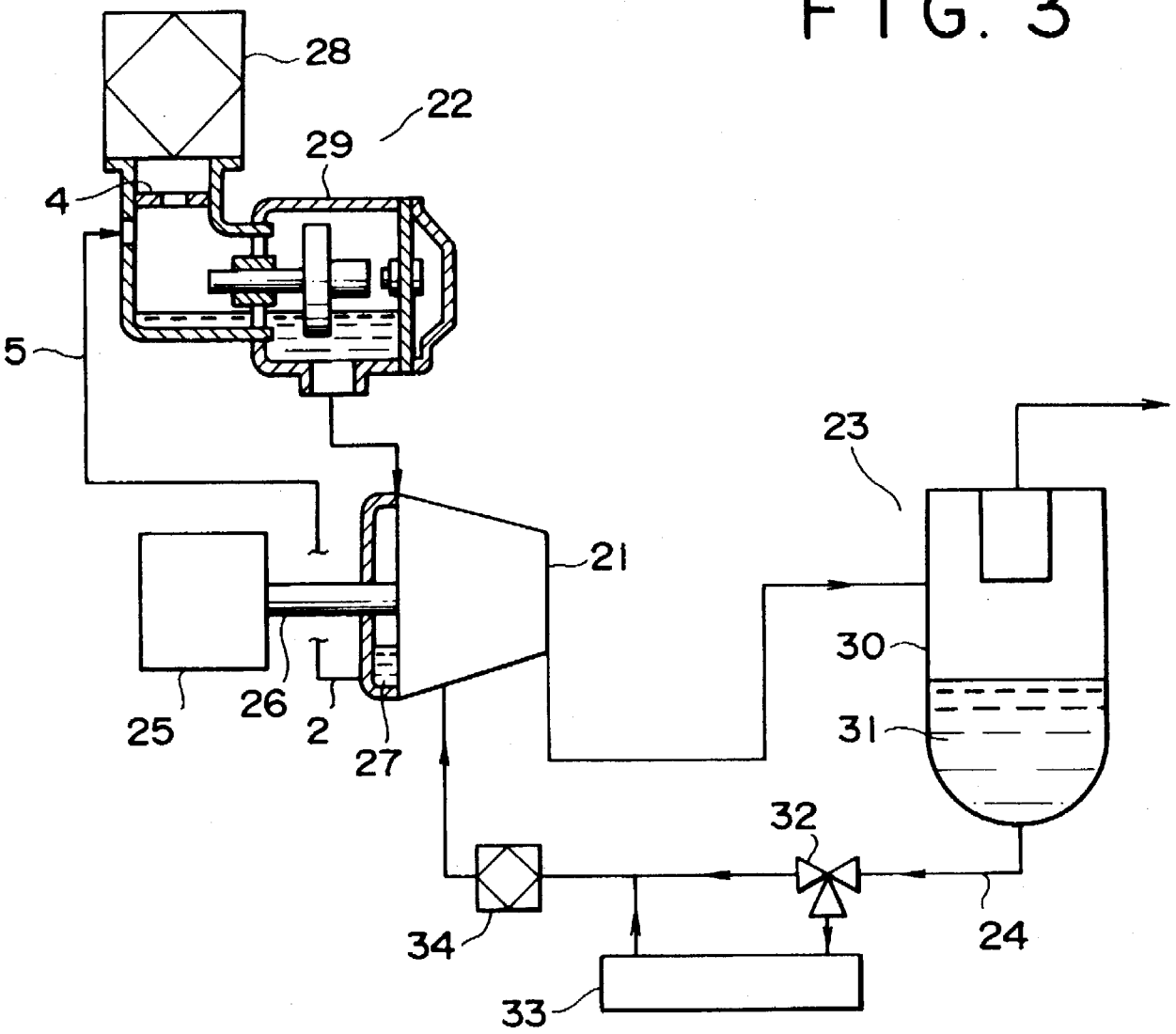
FIG. 3 shows a generalized plan of the air compressor according to a third embodiment of the present invention.

FIG. 3 shows an oil cooled air compressor, for example a screw-type oil cooled air compressor according to the third embodiment of the present invention. Parts in common with the compressor shown in FIG. 3 are designated by the same reference numerals and a detailed explanation thereof is omitted.

This third embodiment also has an orifice 4 installed in line 12 to narrow the cross-sectional area of inlet line 12, as in the first embodiment; it also comprises an oil return line 5 which connects the oil collector unit 27 to the inlet line 12 at a point downstream of orifice 4 but at a point higher than the lower part of the oil collector unit 27.

Air which has passed from air intake filter 28 through orifice 4 expands with a consequent reduction in the pressure thereof. This reduction in pressure causes oil in the oil collector unit to flow to intake regulator valve 29 (via oil return line 5 and inlet line 12). Then, even if the compressor is stopped for some reason and oil collects in the intake regulator valve 29 and inlet line 12, the fact that the oil return line is connected to the inlet line 12 at a point higher than the oil collector unit means that there is no back-flow of oil to the oil collector unit and thus no messy discharge of oil from the oil collector unit when the compressor is restarted. Accordingly, there is no worry of soiling the area surrounding the compressor unit with oil, or causing slipping of the belt on its pulley in the case of a belt-drive type compressor. Furthermore, the reduction in the consumption of oil compared to the prior art compressors means the frequency at which oil must be replenished is reduced.

It is preferred that the oil return line 5 be connected to the inlet line 12 at as high a point as possible in order to assuredly prevent the back-flow of oil from intake regulator valve 29 into oil return line 5.

What is claimed is:

1. An oil cooled air compressor comprising:

a compressor unit having a housing in which rotors are installed for rotation, and provided with an oil collector unit to collect oil leaking at the point where the shaft of one of said rotors passes through said housing to be connected to the drive shaft of a motor used to drive the rotation of said rotors;

an intake regulator valve connected to said compressor unit;

an intake filter connected to said intake regulator valve, wherein said intake filter is connected to said intake regulator valve by a passage having a section of reduced cross-sectional area;

an oil separator connected to said compressor unit;

an oil supply line connecting the lower part of said oil separator to various points inside said compressor unit, to direct oil thereto; and an oil return line connecting said oil collector unit to said passage connecting said intake filter and said intake regulator valve wherein said oil return lines opens into said passage at a point higher than a level of oil in the intake regulator valve.

2. An air compressor comprising:

a compressor unit;

an intake regulator valve connected to said compressor unit;

an intake filter connected to said intake regulator valve by a passage; and a section of reduced cross sectional area in said passage, said section of reduced cross sectional area comprising:

a) a hollow annular element having an inner tube forming said section of reduced cross sectional area, an outer wall around the inner tube, and a hollow region between the outer wall and the inner tube, and b) holes extending through the inner tube to connect the inner tube with the hollow region, wherein air flows between said intake filter and said intake regulator valve via the inner tube and wherein noise from air passing through the inner tube is attenuated in the hollow region.

* * * * *